US010894650B1

(12) United States Patent
Robinson et al.

(10) Patent No.: US 10,894,650 B1
(45) Date of Patent: Jan. 19, 2021

(54) DISPENSING ASSEMBLIES FOR FLEXIBLE PACKAGES

(71) Applicant: L'Oreal, Paris (FR)

(72) Inventors: Michael Robinson, Brooklyn, NY (US); Jason Fyfe, Holmdel, NJ (US); Jeffrey Townsend, Cranford, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/457,358

(22) Filed: Jun. 28, 2019

(51) Int. Cl.
*B65D 47/06* (2006.01)
*B65D 75/58* (2006.01)

(52) U.S. Cl.
CPC ..... *B65D 75/5883* (2013.01); *B65D 47/06* (2013.01); *B65D 2575/583* (2013.01)

(58) Field of Classification Search
CPC ..... B65D 75/5883; B65D 2575/583; B65D 47/06
See application file for complete search history.

(56) References Cited

U.S. PATENT DOCUMENTS 4,241,855 A * 12/1980 Yoshioka ..... B65D 47/06 222/479
4,322,014 A * 3/1982 Philip ..... B65D 25/04 206/499
4,637,530 A * 1/1987 Jiang ..... B65D 25/42 222/564
5,605,254 A * 2/1997 Wagner, III ..... B65D 47/0842 222/108
6,997,360 B2 * 2/2006 Cohn ..... A47G 19/145 220/719
7,735,699 B2 * 6/2010 Brannon ..... B65D 47/0842 215/235
7,845,524 B2 * 12/2010 Evans ..... G01F 11/262 222/1
8,336,745 B2 * 12/2012 Brannon ..... B65D 47/06 215/235
9,302,827 B1 * 4/2016 Goss ..... B65D 47/32
(Continued)

FOREIGN PATENT DOCUMENTS

JP H08 91407 A 4/1996
JP 2012-116563 A 6/2012
WO 2018/230460 A1 12/2018

OTHER PUBLICATIONS

International Search Report and Written Opinion dated Aug. 27, 2020, issued in International Application No. PCT/US2020/039871, filed Jun. 26, 2020, 13 pages.

*Primary Examiner* — Frederick C Nicolas
(74) *Attorney, Agent, or Firm* — Christensen O'Connor Johnson Kindness PLLC

(57) ABSTRACT

A fitment for a package with an interior compartment for containment of a flowable material is described. The fitment may have a body with an exterior wall and an interior wall. The interior wall may define a passageway extending through the body from a top opening to a bottom opening. The fitment may have at least one dispersion member with an edge extending into the passageway, the edge dividing at least a portion of a width of the passageway extending between the interior wall. The fitment may include a baffle member having a surface extending into, and at least partially obstructing, the passageway. The fitment may include a flange portion associated with the exterior wall, the flange portion positioned to interface the fitment with the package.

17 Claims, 6 Drawing Sheets

(56) References Cited

U.S. PATENT DOCUMENTS

| | | | | |
|---|---|---|---|---|
| 10,071,837 | B2 * | 9/2018 | Franca | B65D 47/2031 |
| 10,486,880 | B2 * | 11/2019 | Franca | B29C 66/53263 |
| 2007/0290013 | A1 * | 12/2007 | Yamane | B65D 41/26 222/547 |
| 2011/0132941 | A1 * | 6/2011 | Kim | B65D 75/5883 222/566 |

* cited by examiner

DISPENSING ASSEMBLIES FOR FLEXIBLE PACKAGES

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

One embodiment includes a fitment for a package with an interior compartment for containment of a flowable material. The fitment includes a body having an exterior wall and an interior wall. The interior wall defines a passageway extending through the body from a top opening to a bottom opening. The fitment also includes at least one dispersion member having an edge extending into the passageway, the edge dividing at least a portion of a width of the passageway extending between the interior wall. The fitment also includes a baffle member having a surface extending into, and at least partially obstructing, the passageway. The fitment also includes a flange portion associated with the exterior wall, the flange portion positioned to interface the fitment with the package.

In another embodiment, the fitment further may include a first plane defined by the top opening. The fitment may also include a second plane defined by the bottom opening that is disposed at an angle with respect to the first plane.

In some embodiments, the first plane may be disposed at angle about 30-60 degrees with respect to the second plane.

In some embodiments, the baffle member includes a planar surface, the planar surface of the baffle member being co-planar with the first plane defined by the top opening of the passageway. In some embodiments, the baffle member may partially obstruct the first opening. In some embodiments, a spout may be formed by the baffle member and the first opening and positioned to pour the flowable material.

In embodiments, the at least one dispersion member may have a first end having a first cross-sectional area extending between the at least one dispersion member and the baffle member and the at least one dispersion may have a second end having a rectangular cross-section. In some embodiments, the at least one dispersion member has a non-symmetrical cross-section. In some embodiments, the at least one dispersion member may have a first end and a second end opposite the first end, the first end of the dispersion member may have a first triangular cross-sectional area and the second end of the at least one dispersion member may have a rectangular cross-section.

In some embodiments, the fitment may further include a second dispersion member having a second edge extending into the passageway, the second edge positioned to divide the flow of the flowable material through a portion of the width of the passageway. In some embodiments, a first dispersion member may be parallel with respect to the second dispersion. In alternative embodiments, a first dispersion member may be disposed at an angle with respect to the second dispersion member. In some embodiments, the at least one dispersion member may have a varying width along a length of the at least one dispersion member. In other embodiments, the at least one dispersion member may have a varying thickness along a length of the at least one dispersion member.

In some embodiments, the flange portion may maintain the bottom opening in fluid communication with the interior compartment of the package.

In still another embodiment, a fitment for a package with an interior compartment for containment of a flowable material is described. The fitment may include a body having an exterior wall and an interior wall, the interior wall defining a passageway extending through the body from a top opening to a bottom opening. The fitment also includes a dispersion member having an edge extending into the passageway, the edge dividing at least a portion of a width of the passageway extending between the interior wall. The fitment also includes a baffle member having a planar surface extending into, and at least partially obstructing, the top opening, where the baffle member is coplanar with the top opening. The fitment also includes a spout formed by the baffle member and the first opening and positioned to pour the flowable material. The fitment also includes a flange portion associated with the exterior wall, the flange portion positioned to interface the fitment with the package.

In yet another embodiment, a package for a flowable material is described herein. The package includes at least two walls defining an interior compartment for storing the flowable material and a fitment in fluid communication with the interior compartment. The fitment includes a body having an exterior wall and an interior wall, the interior wall defining a passageway extending through the body from a top opening to a bottom opening. The fitment also includes at least one dispersion member having an edge extending into the passageway, the edge dividing at least a portion of a width of the passageway extending between interior wall. The fitment also includes a baffle member having a planar surface extending into, and at least partially obstructing, the top opening, where the baffle member is coplanar with the top opening. The fitment also includes a spout formed by the baffle member and the first opening and positioned to pour the flowable material. The fitment also includes a flange portion associated with the exterior wall, the flange portion positioned to interface the fitment with the package and maintain the bottom opening in fluid communication with the interior compartment of the package.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The packaging industry has seen advances in both packaging media and devices that facilitate dispensing and/or provide resealability of a package. For some types of product, especially flowable materials, a trend in packaging media has shifted from the use of rigid materials to more flexible materials. Flexible packaging provides a number of advantages, including handling and shipping advantages.

Another shift has been to the use of plastic spouts or fitments to provide access to the product inside the flexible package. Such fitments generally permit ready access to the product and may also provide resealability of the package to reduce or prevent contamination of the product, leakage, spillage, and so forth.

Fitments include a flange and a rigid, upstanding, tubular spout. Some have a cap or closure attached thereto, or a thread or other connection for receiving the same. Fitments can be formed of a rigid material so that the fitment retains its shape for accessing the interior of the package, receiving the closure, maintaining the closure engaged with the fitment, and so forth. The fitment is mounted to the flexible package by means of the flange. For example, the flange, or a portion thereof, may extend through an opening of the flexible package into the interior thereof, in a manner that maintains the opening in an open configuration, to allow product to move through the fitment.

One challenge with flowable materials such as fluids, particulate solids, and so forth, is that the material may resist flowing from the interior of the flexible package through the fitment, for example when a user attempts to dispense the product. This may be due to factors such as the flowable material blocking the opening, or the nature of the flowable material itself. Powders and other particulate solids, for example, may clump together and/or adhere to interior surfaces of the fitment. Other flowable materials may possess or exhibit non-Newtonian characteristics.

The following description provides several examples that relate to fitments suitable for use with packaging that contains a flowable material. Of course, the fitments provided in these examples may find use with both rigid and flexible packaging, and transcends any material type contained in such packaging. In that regard, in one or more embodiments described below, the fitment generally includes a flange, a spout, and a dispersion member associated with the spout. In some embodiments, the dispersion member acts upon the flowable material as it is exiting the package to break apart any clumps and provide a smooth flow out of the container.

Figure 1:
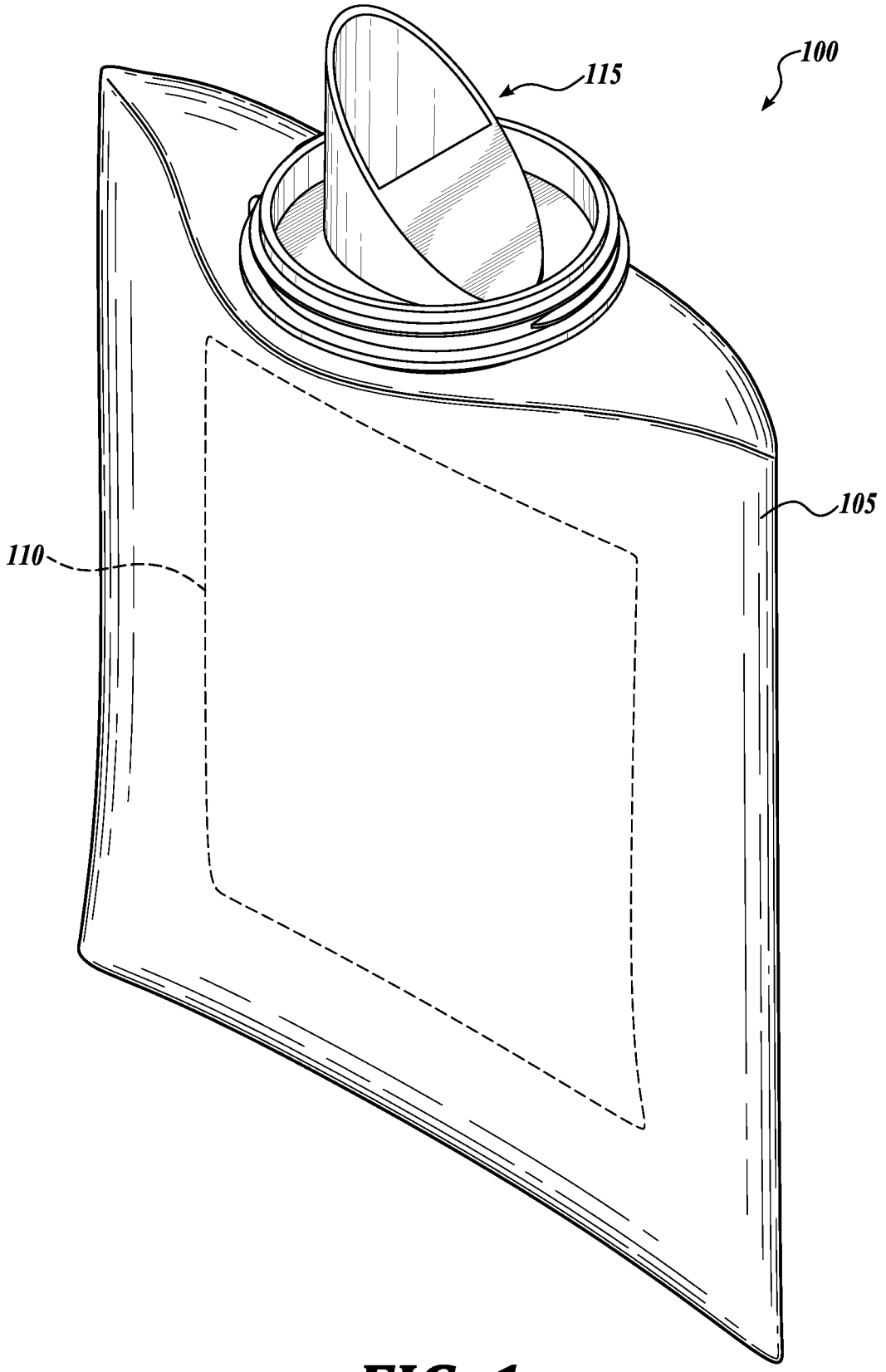
FIG. 1 is an isometric view of a representative fitment on a representative package in accordance with an embodiment of the present disclosure.

FIG. 1 is an isometric view of a representative packaging system 100 in accordance with the present disclosure. The package system 100 includes a package 105 with an interior compartment 110 for holding a flowable material (not shown). The flowable material may consist of a liquid, powder, solids, particulate solids, or a combination thereof. The package system 100 may also include a fitment 115 which may be coupled to the package 105. In one embodiment, the fitment 115 may be removably coupled to the package 105 or, in an alternative embodiment, the fitment 115 may be fixed to the package 105. The fitment 115 may fluidly communicate with the interior compartment 110 to allow the flowable material to exit the package 105. When the package system 100 is tilted, the flowable material may exit the package 105 through the fitment 115.

Figure 2:
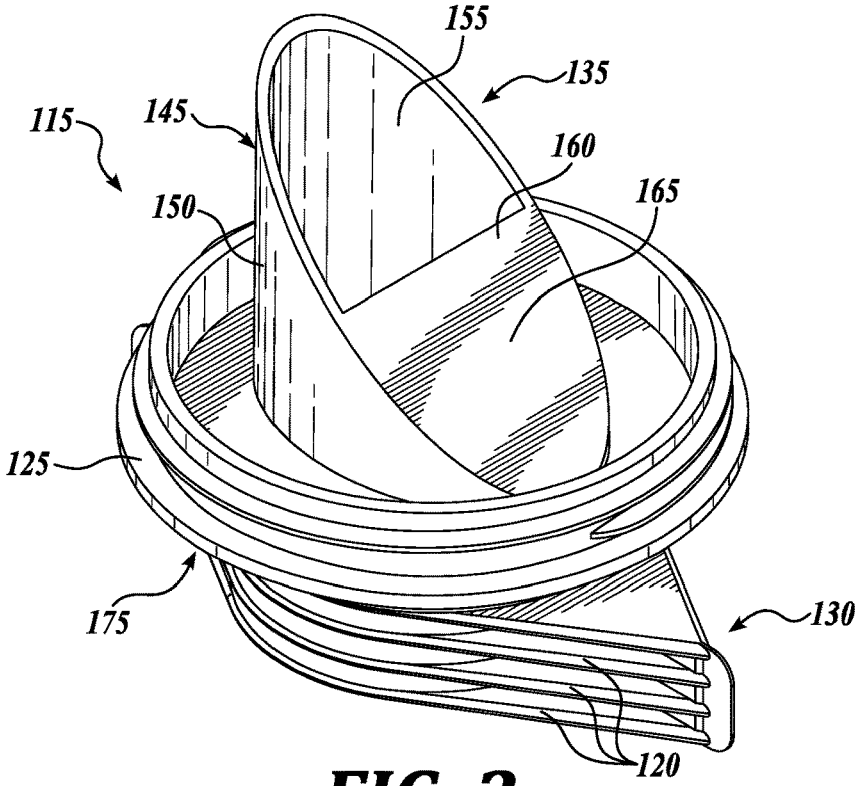
FIG. 2 is an isometric view of the fitment of FIG. 1.

Turning now to FIG. 2, there is shown an isometric view of the fitment 115 described with reference to FIG. 1. The fitment 115 may have a base 130 enclosed within the package 105 when the fitment 115 is assembled as part of the package system 100. The fitment 115 may further include a flange 125 to position the fitment 115 on the package 105 and a spout 135 extending upward from the flange 125.

Figure 6:
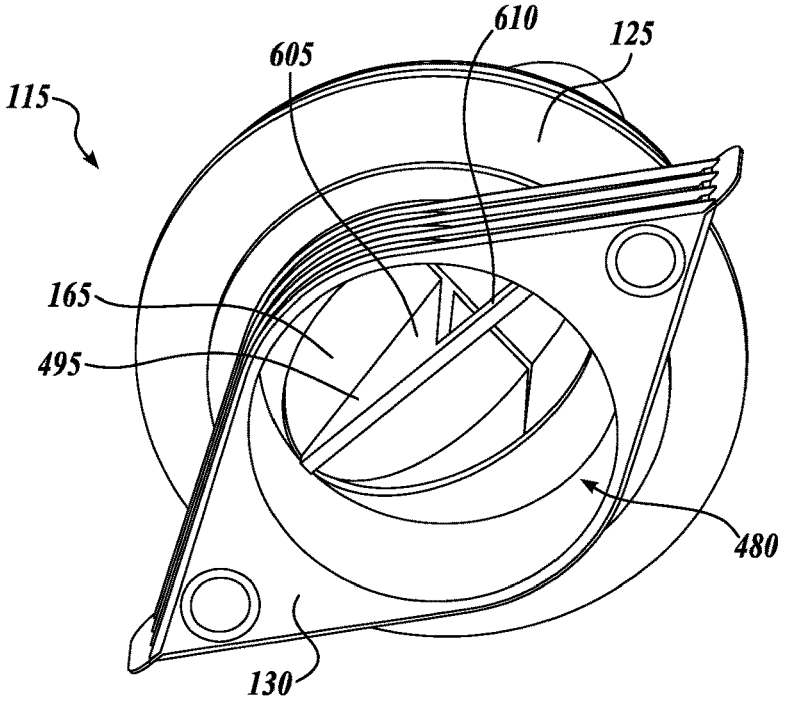
FIG. 6 is a bottom isometric view of the fitment of FIG. 1.

In some embodiments, the base 130 may comprise a symmetrical shape. For example, as shown in FIG. 6, the base 130 may be generally canoe shaped, football shaped, or the like. Referencing again FIG. 2, the base 130 may be formed of solid material or may include honeycomb or ridges 120 to maintain the shape of the base 130. Ridges 120 may use less material and comprise a cost and/or weight savings. When assembled, the base 130 may rest inside the package 105 and connect the spout 135 to the interior compartment 110. In addition, the base 130 may provide a foundation for the spout 135 to maintain a position of the spout 135 relative to the package 105.

Figure 3:
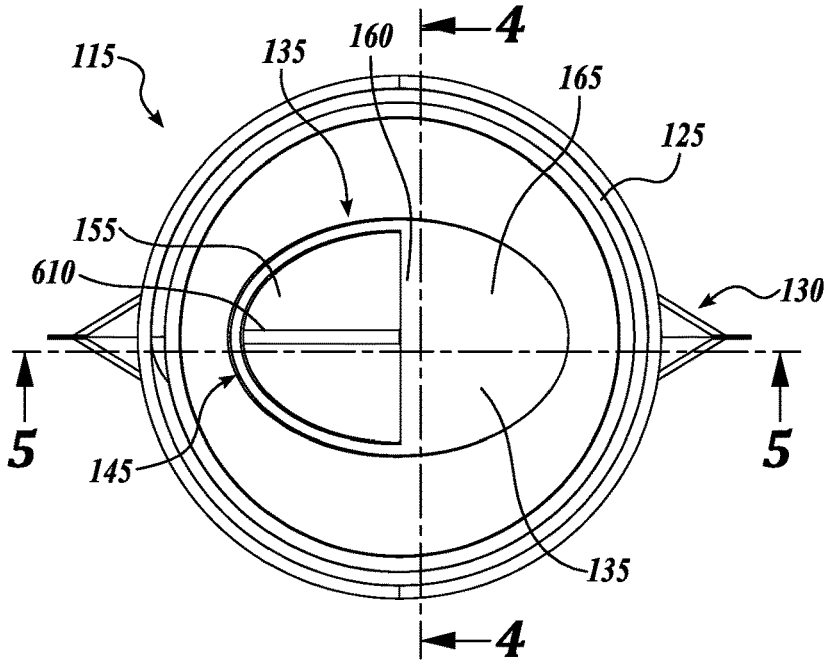
FIG. 3 is top down view of the fitment of FIG. 1.
Figure 4:
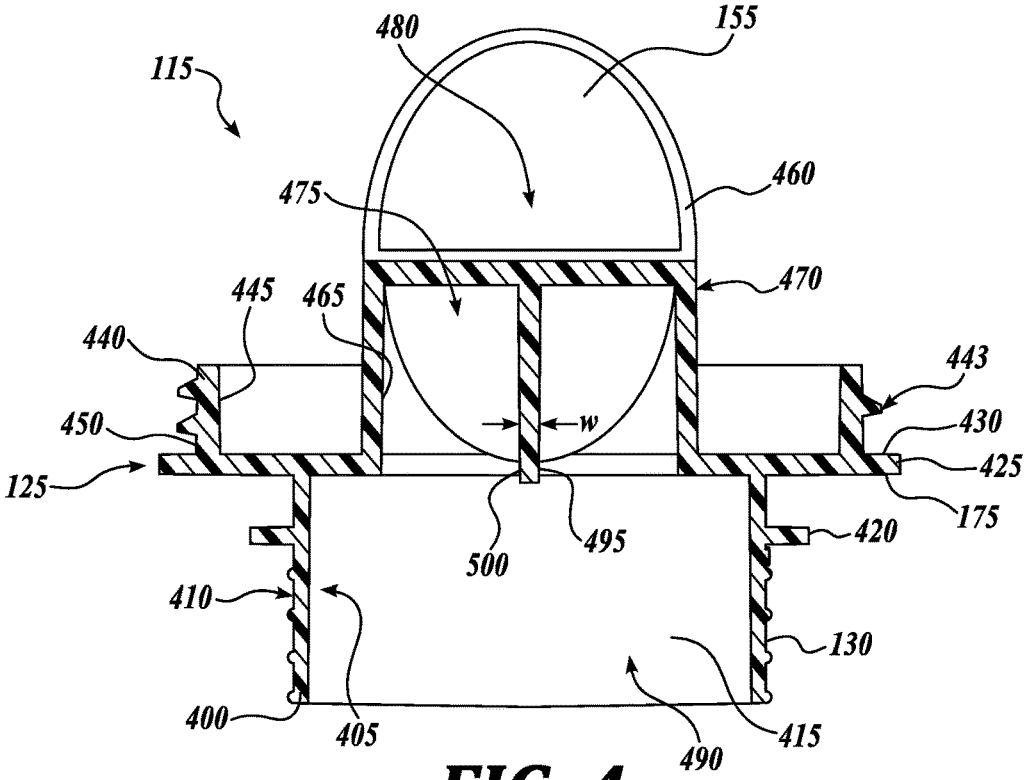
FIG. 4 is a cross-sectional view of the fitment along lines 4-4 in FIG. 3.

Referring now to the embodiment of FIGS. 2-4, the flange 125 is integrally formed or otherwise connected to the base. In some embodiments, the flange 125 may provide structural stability for the spout 135. For example, the flange 125 may position the spout 135 on an external surface of the package 105. In some embodiments, the flange 125 may provide a stable foundation to support the positioning of the spout 135. A lower surface 175 of the flange 125 may rest on the external surface of the package 105, as shown in FIG. 4. The flange comprises a generally cylindrical shape. However, the flange 125 may comprise any polygonal or curved shape providing a solid foundation to the spout 135.

In some embodiments, the fitment 115 may include an outer wall 145 forming a body 150 of the spout 135. The body 150 may extend perpendicularly or orthogonally the flange 125. In some embodiments, a top surface 160 of the body 150 may define a first plane which may intersect with a plane defined by the flange 125, as shown in FIG. 2. Therefore, in some embodiments, the top surface 160 of the spout 135 and the flange 125 may form an angular relationship, as will be described in more detail below. Of course, the top surface 160 of the body 150 may be parallel to the flange 125 in other embodiments.

In some embodiments, the body 150 of the spout 135 may form a cylinder. The cylinder may be circular, or as shown, may have a somewhat oval circumference. In alternative embodiments, the body 150 may be any rounded or polygonal tubular shape. In some embodiments, the top surface 160 of the body 150 includes an opening 155 that forms the spout outlet. In some instances, the opening 155 may be at least partially blocked or covered by a baffle 165 formed in the top surface 160. In other embodiments, the baffle 165 may not be coplanar with the top surface 160 and instead may be positioned within the body 150 of the spout 135.

Figure 5:
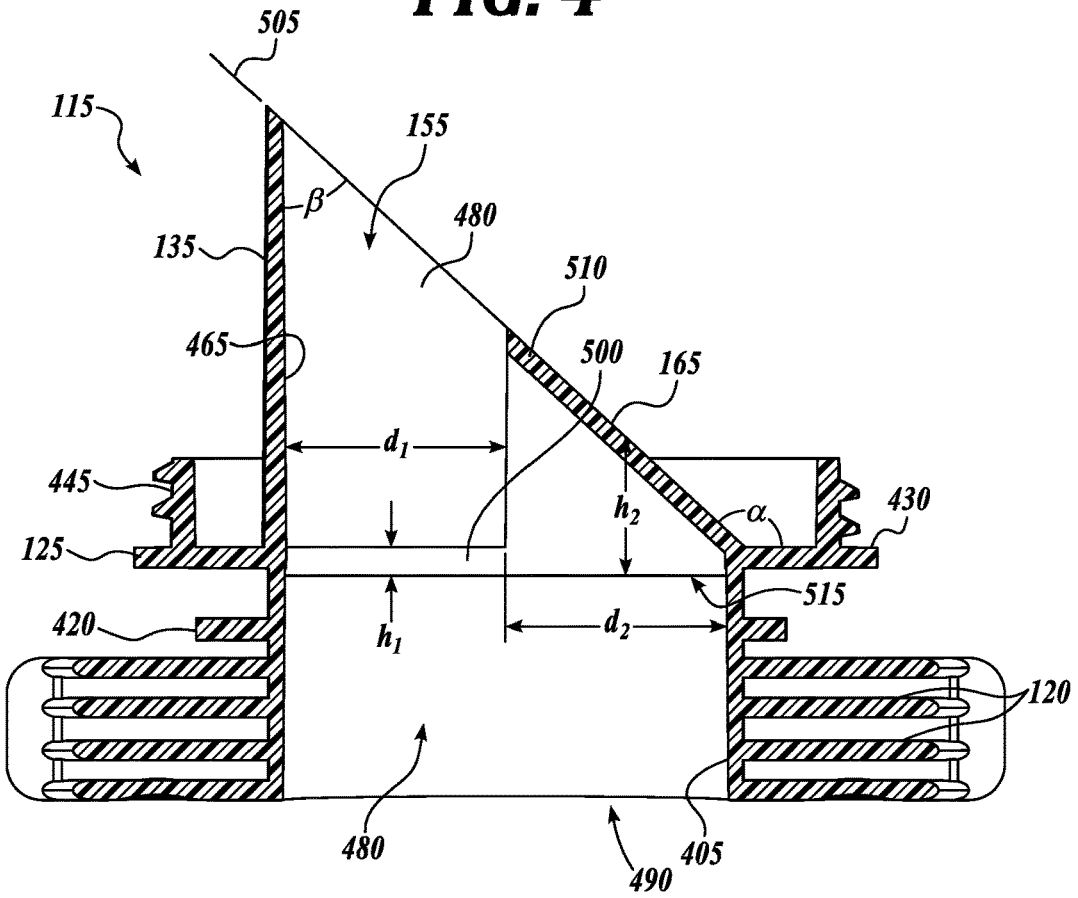
FIG. 5 is a cross-sectional view of the fitment along lines 5-5 in FIG. 3.

As shown in the cross-sectional view of FIG. 5, taken along lines 5-5 of FIG. 3, the baffle 165, in this instance, is co-planar with the top surface 160 of the spout 135. The cross-sectional view in this example shows an integrally formed fitment 115 comprised of the base 130, the flange 125, and the spout 135.

Referring again to the cross-sectional view of FIG. 4, taken along lines 4-4 of FIG. 3, the base 130 in some embodiments may include a wall 400 with an inner surface 405 defining a lower passageway 415 there though. The wall 400 may have a polygonal or rounded shape. In the embodiment shown, the wall 400 comprises a cylindrical inner surface 405. In the embodiment shown, the inner surface 405 at the lower end of the base 130 forms a lower opening 490, which can function as the fitment inlet.

In one embodiment, the outer surface 410 of the wall 400 may be cylindrically shaped or, in alternative embodiments, the outer surface 410 may incorporate one or more features such as the canoe-shaped ridges 120 as shown in the embodiment of FIG. 2. In some embodiments, the base 130 may include a flange 420, which is shown spaced from and below the flange 125. The flange 420 may extend the entire circumference of the wall 400 or sections thereof. In some embodiments, the flange 420 may have a constant thickness and width. In some embodiments, the flange 420 may have a varying thickness and width. In some embodiments, the flange 420 may position the fitment 115 on the package 105.

For example, in some embodiments, the flange 125 includes a body 425 that defines the lower surface 175 of the flange 125 spaced a distance above the flange 420. The body 425 may be substantially planar or may include a variety of shapes and contours. In some embodiments, he body 425 and the flange 420 may aid in the positioning and attachment of the fitment 115 on the package 105. For example, a surface of the package 105 may fit between the flange 420 and the body 425. This may position the fitment 115 on the package 105 and retain the fitment 115 in a fixed position. The fixed position may be an upright position as shown in FIG. 1 or, in alternative embodiments, may be an angled or rotated position.

In some embodiments, a wall 440 may be coupled to the upper surface 430 of the flange body 425. The wall 440 may be configured to removably couple a cap to the fitment 115. In the embodiment shown, the wall 440 is orthogonal to the upper surface 430 of the body 425 of the flange. In alternative embodiments, the wall 440 may have a concave or convex inner surface 445 such that the inner surface 445 and the flange 125 form either an obtuse or oblique angle. In some embodiments, the wall 440 may have a series of threads 443 on an outer surface 450. The threads 443 could also be positioned on an inner surface 455 or on the flange body 425 itself. In alternative embodiments, the outer surface 450 could incorporate a groove, lip, or other feature. These features, or threads 443, may be configured to mate with a cooperating feature of the cap (see cap 700 in FIG. 7).

Still referring to FIG. 4, the spout 135 in some embodiments may extend from the body 425 of the flange 125. In some embodiments, the spout 135 may be substantially orthogonal to the upper surface 430 of the flange 125. In alternative embodiments, the spout 135 may extend at an angle from the upper surface 430 or have an irregular shape. The outer wall 145 of the spout body 155 includes an inner surface 465 defining an upper passageway 475. The upper passageway 475 and lower passageway 415 may define a larger passageway 480 interconnecting the upper opening 155 and the lower opening 490.

In some embodiments, the wall 145 may form a substantially cylindrical shape with an inner diameter along the inner surface 465. In some embodiments, a dispersion member 495 may be positioned in the passageway 480, as shown in FIGS. 4-6. The dispersion member 495 aims to disperse clumps or modules formed within the flowable material and enable the material to easily flow from the interior compartment 110 of the package 105.

The dispersion member 495 may intersect at least a portion of the passageway 480. For example, a length of the dispersion member 495 may vary. In some embodiments, the length of the dispersion member 495 may be equivalent to a diameter of the passageway 480. In other embodiments, the length of the dispersion member 495 may be a ratio or percentage of the diameter of the passageway 480 such that the dispersion member 495 is cantilevered into the passageway 480. In some embodiments, the dispersion member 495 may intersect a middle of the passageway 480. In alternative embodiments, the dispersion member 495 may be offset from a centerline of the passageway 480. In still further embodiments, multiple dispersion members 495 may be positioned in the passageway.

As shown in FIGS. 4 and 5, the dispersion member 495 may have a body 500 with a height h and a width w. In some embodiments, the height h and width w of the body 500 may be constant. In alternative embodiments, either the height h or the width w may remain constant while the other varies. For example, in the embodiment shown in FIG. 4, the width w of the dispersion member is constant, but as shown in FIG. 5, the height h of the dispersion member 495 varies. Similarly, in some embodiments, the width w of the dispersion member 495 may vary but the profile of the dispersion member 495 may remain constant. For example, the dispersion member 495 may have a knife-edge, a triangular cross-section, a trapezoidal cross-section, or another cross-section which may aid in the breakup of clumping material. A pointed or narrow end of the cross-section may face the bottom opening 490.

As briefly stated above, the top surface 160 of the spout 135 and the flange 125 may form an angular relationship. In that regard, the top opening 155 may form a first plane 505 which may extend at an angle $\alpha$ from the upper surface 430 of the flange 125, as shown in FIG. 5. The position of the first plane 505 may also be described with reference to the cylindrical wall 150 of the spout 135. For example, the first plane 505 may form an angle $\beta$ with a portion of the cylindrical body of the spout 135. In some embodiments, angle $\alpha$ may be between about 120-150 degrees. In other embodiments, angles $\alpha$ may be approximately 135 degrees. In other embodiments, angle $\beta$ may be between about 30-60 degrees. In other embodiments, angles $\beta$ may be approximately 45 degrees. The angle $\alpha$ may also be a factor in predicting material flow. For example, in some embodiments, the opening 155 may increase or decrease as either angle $\alpha$ or angle increases or decreases. The size of the opening 155 may help determine the viscosity and flow characteristics of the material.

As also briefly stated above, a baffle 165 is formed in the top surface 160 of the spout 135. In that regard, the baffle 165 in some embodiments may have a body 510 which may be co-planar with the first plane 505. In other embodiments, the baffle 165 may protrude from the inner surface 465 and into the passageway 480. The baffle 165 may extend a portion into the passageway 480. For example, the baffle 165 may extend a quarter, halfway, three quarters, or some variation thereof into the passageway 480. The baffle 165 may limit a size of the opening 155. The baffle 165 may also direct a flow of the material held within the interior compartment 110 of the package 105.

The dispersion member 495 may also affect material flow. In some embodiments, the material may clump or congeal into larger lumps which may hinder the flow of the material. In some embodiments, the dispersion member 495 may interrupt the flow of the material and break up the lumps and alter the material from a non-Newtonian flow to Newtonian flow characteristics. The dispersion member 495 may also change the flow of the material. For example, the dispersion member 495 may change the flow from laminar to turbulent to cause the material to break apart and ease into a better flow viscosity and characteristics.

Various parameters of the dispersion member may affect material flow. In some embodiments, the width w of the dispersion member 495 as well as the height h may affect the flow of the material. For example, the width w may be wide enough to disrupt the lumps that form in the material. In some embodiments, the width w may be a ratio of the total area of the passageway 480. In some embodiments, multiple dispersions members 495 may be used to achieve or increase the ratio. In some embodiments, the multiple dispersion members 495 may be parallel, skewed, or orthogonal to each other. The various arrangements of the dispersion members 495 may be based at least in part on the type of material being stored in the packaging system 100.

Similarly, the height h of the dispersion member 495 may affect the flow of the material. As shown in FIG. 5, the height h of the dispersion member 495 changes along a length of the dispersion member 495. In the embodiment shown in FIG. 5, the dispersion member 495 has a first height $h_1$ along a first distance $d_1$ and a second height $h_2$ along a second distance $d_2$. In some embodiments, the height may be variable across a length of the dispersion member 495 or along the entire dispersion member 495. In other embodiments, the dispersion member 495 may have a fixed height $h_1$ along a first portion of a length $d_1$ of the dispersion member 495 and a variable height $h_2$ along the second portion of the length $d_2$ of the dispersion member 495.

In some embodiments, the variable height $h_2$ may increase along a length of the dispersion member 495. In some embodiments, the dispersion member 495 may extend from a bottom surface 515 of the dispersion member 495 to the baffle member 165. In the embodiment shown in FIGS. 5 and 6, the dispersion member 495 may have a first triangular shape 605 coupled to a substantially rectangular member 610 projecting across an inner diameter of the spout 135

Figure 7:
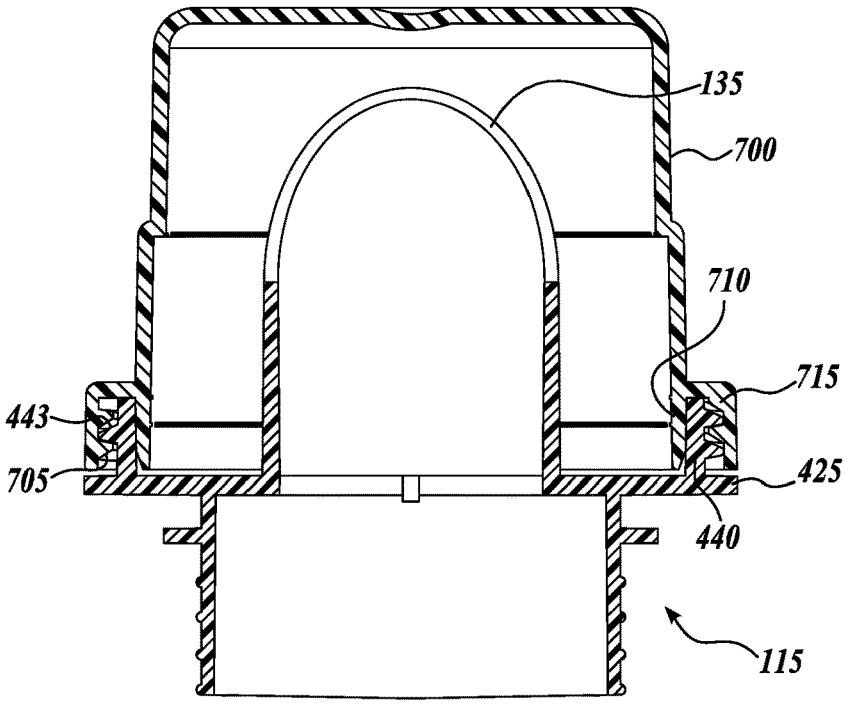
FIG. 7 is a cross-sectional view of the fitment along lines 5-5 in FIG. 3 with a cap.

FIG. 7 is a cross-sectional view through the fitment 115 with a cap 700 affixed thereto. In some embodiments, the he cap 700 may have a series of threads 705 that mate with a series of threads 443 on the fitment 115. The threads 705 may be on an inner wall 710 of the cap 700 or may be on a flange 715 which may accept the wall 440 and screw into the threads 443 of the fitment 115. In alternative embodiments, the cap 700 may snap or otherwise removably affix to the fitment 115.

Figure 8A:
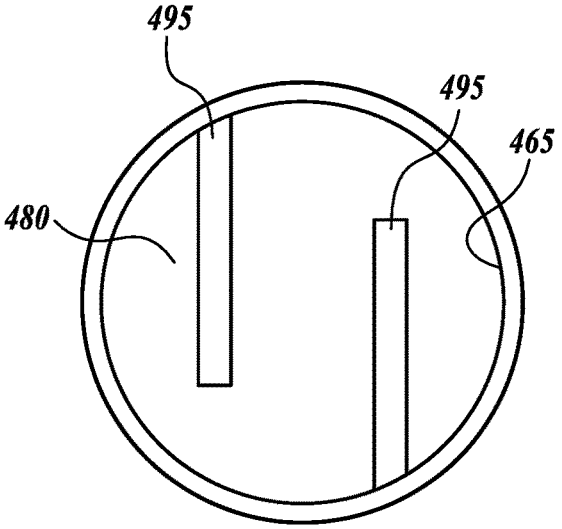
FIGS. 8A-8D are alternative embodiments of the representative dispersion member configuration of the fitment of FIG. 1.
Figure 8B:
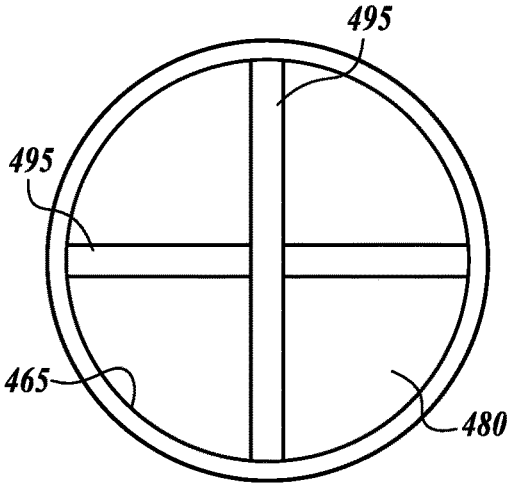
Figure 8C:
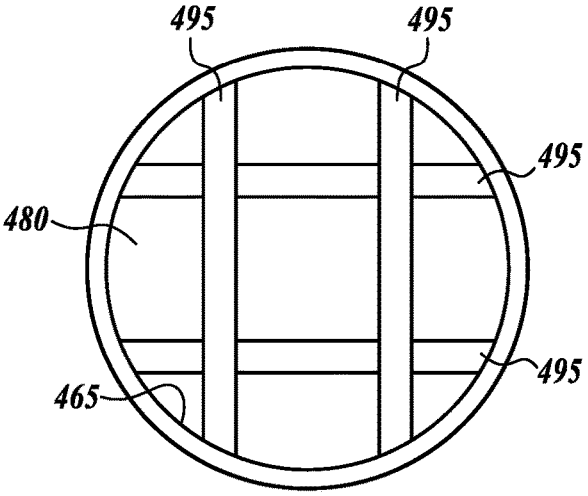
Figure 8D:
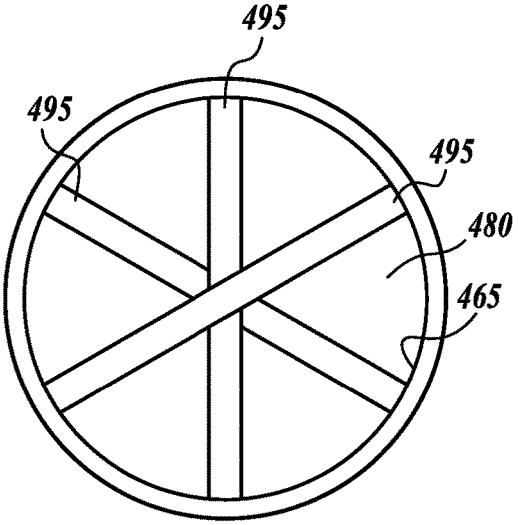

FIGS. 8A-8D are exemplary alternative embodiments of the dispersion member 495 positioned in the passageway 480. FIG. 8A shows two parallel dispersion members 495 cantilevered into the passageway 480. FIG. 8B shows two dispersion members 495 perpendicular to each other. FIG. 8C shows a hatched pattern of dispersion members 495. FIG. 8D shows an alternative hatched pattern of the dispersion members 495.

In each embodiment, the dispersion members 495 may be co-planar, and in some instances, intersect. In alternative embodiments, the dispersion members 495 may be positioned in different planes within the passageway 480 and may not intersect. In still further embodiments, the dispersion members 495 may not be perpendicular to the inner surface 465 of the passageway 480. For example, the dispersion member 495 may angularly span the passageway 480.

In some embodiments, multiple dispersion members 495 may be present in different planes. For example, the patterns shown in FIGS. 8A-8D, or alternative patterns, may repeat in different planes such that from a top down perspective you would only see the number of dispersion members 495 shown, but the actual number may be a multiple of that. For example, FIG. 8A may have four dispersion members 495 wherein two sets of dispersions members 495 are stacked.

Figure 9A:
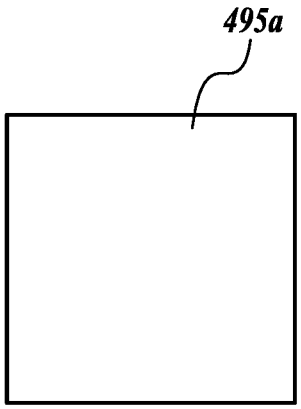
FIGS. 9A-9D are alternative embodiments of the representative dispersion member configuration of the fitment of FIG. 1.
Figure 9B:
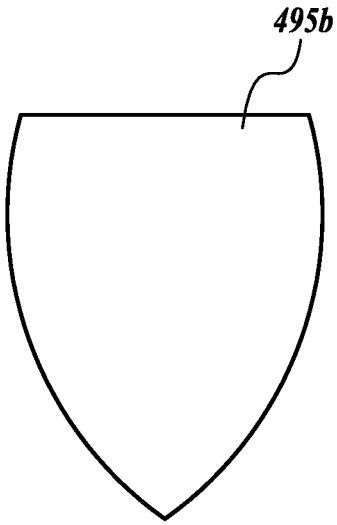
Figure 9C:
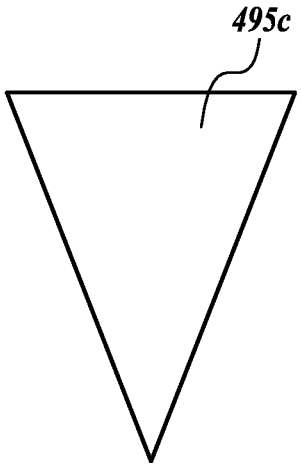
Figure 9D:
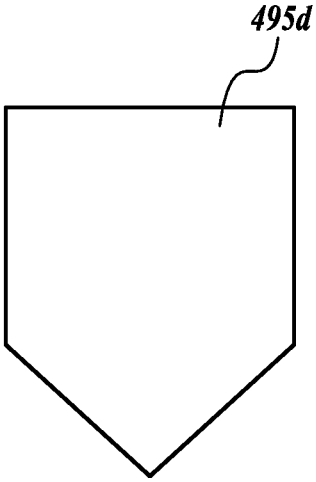

FIGS. 9A-9D show a variety of cross-sections of the dispersion member 495. For example, in FIG. 9A, the dispersion member 495*a* has a square cross-section. In FIG. 9B, the dispersion member 495*b* has a knife-like cross-section. In FIG. 9C, the dispersion member 495*c* has a triangular cross-section. In FIG. 9D, the dispersion member 495*d* has a polygonal cross-section. Other cross-sectional shapes may also be used. In some embodiments, if more than one dispersion member 495 is present, the dispersion members 495 may have the same or different cross-sections.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of a beauty tool and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein. For instance, any feature or configuration described above with respect to the core may be adapted for use with the cover, and vice versa.

Although certain descriptive terms are used to illustrate or describe certain aspects or benefits of the present invention, they should not be seen as limiting. For instance, although the term "keratinous treatment(s)" is used, it should be appreciated that any or all of the beauty tools described and illustration herein may also be used for other uses not mentioned.

The present disclosure also includes references to directions, such as "upper," "lower," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic formulation" or "cosmetic" (as used with the phrase "beauty tool") should be interpreted broadly to include any cosmetic formulation, beauty product, lotion, lacquer, etc., generally applied to a person's skin, eyes, nails, or other body part.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "substantially," "about," "approximately," etc., mean plus or minus 5% of the stated value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A fitment for a package with an interior compartment for containment of a flowable material, the fitment comprising:

a body having an exterior wall and an interior wall, the interior wall defining a passageway extending through the body from a top opening to a bottom opening;

a first plane defined by the top opening;

a second plane defined by the bottom opening that is disposed at an angle with respect to the first plane;

at least one dispersion member having an edge extending into the passageway, the edge dividing at least a portion of a width of the passageway extending between the interior wall;

a baffle member having a surface extending into, and at least partially obstructing, the passageway, wherein the baffle member includes a planar surface, the planar surface of the baffle member being co-planar with the first place defined by the top opening of the passageway; and a flange portion associated with the exterior wall, the flange portion positioned to interface the fitment with the package.

2. The fitment of claim 1, wherein the first plane is disposed at angle between 30-60 degrees with respect to the second plane.

3. The fitment of claim 1, wherein the baffle member partially obstructs the first opening.

4. The fitment of claim 1, further including:

a spout formed by the baffle member and the first opening and positioned to pour the flowable material.

5. The fitment of claim 1, wherein the at least one dispersion member has a first end having a first cross-sectional area extending between the at least one dispersion member and the baffle member; and wherein the at least one dispersion has a second end having a rectangular cross-section.

6. The fitment of claim 1, wherein the at least one dispersion member has a non-symmetrical cross-section.

7. The fitment of claim 1, wherein the at least one dispersion member has a first end and a second end opposite the first end, the first end of the dispersion member having a first triangular cross-sectional area and the second end of the at least one dispersion member having a rectangular cross-section.

8. The fitment of claim 1, further including:

a second dispersion member having a second edge extending into the passageway, the second edge positioned to divide the flow of the flowable material through a portion of the width of the passageway.

9. The fitment of claim 8, wherein a first dispersion member is parallel with respect to the second dispersion.

10. The fitment of claim 8, wherein a first dispersion member is disposed at an angle with respect to the second dispersion member.

11. The fitment of claim 1, wherein the at least one dispersion member has a varying width along a length of the at least one dispersion member.

12. The fitment of claim 1, wherein the at least one dispersion member has a varying thickness along a length of the at least one dispersion member.

13. The fitment of claim 1, wherein the flange portion maintains the bottom opening in fluid communication with the interior compartment of the package.

14. A fitment for a package with an interior compartment for containment of a flowable material, the fitment comprising:

a body having an exterior wall and an interior wall, the interior wall defining a passageway extending through the body from a top opening to a bottom opening;

a dispersion member having an edge extending into the passageway, the edge dividing at least a portion of a width of the passageway extending between the interior wall;

a baffle member having a planar surface extending into, and at least partially obstructing, the top opening, wherein the baffle member is coplanar with the top opening;

a spout formed by the baffle member and the first opening and positioned to pour the flowable material; and a flange portion associated with the exterior wall, the flange portion positioned to interface the fitment with the package.

15. The fitment of claim 14, wherein the at least one dispersion member has a first end having a first cross-sectional area extending between the at least one dispersion member and the baffle member; and wherein the at least one dispersion member has a second end having a rectangular cross-section.

16. The fitment of claim 14, further including:

a first plane defined by the top opening; and a second plane defined by the bottom opening that is disposed at an angle with respect to the first plane.

17. A package for a flowable material, the package comprising:

at least two walls defining an interior compartment for storing the flowable material;

a fitment in fluid communication with the interior compartment, the fitment comprising:

a body having an exterior wall and an interior wall, the interior wall defining a passageway extending through the body from a top opening to a bottom opening;

at least one dispersion member having an edge extending into the passageway, the edge dividing at least a portion of a width of the passageway extending between the interior wall;

a baffle member having a planar surface extending into, and at least partially obstructing, the top opening, wherein the baffle member is coplanar with the top opening;

a spout formed by the baffle member and the first opening and positioned to pour the flowable material; and a flange portion associated with the exterior wall, the flange portion positioned to interface the fitment with the package and maintain the bottom opening in fluid communication with the interior compartment of the package.

* * * * *